US007134774B2

(12) United States Patent
Iwasaki

(10) Patent No.: US 7,134,774 B2
(45) Date of Patent: Nov. 14, 2006

(54) PROJECTOR TYPE VEHICULAR LAMP DEVICE

(75) Inventor: Kazunori Iwasaki, Yamato (JP)

(73) Assignee: Ichikoh Industries, Ltd., Tokyo (JP)

( * ) Notice: Subject to any disclaimer, the term of this patent is extended or adjusted under 35 U.S.C. 154(b) by 47 days.

(21) Appl. No.: 11/058,602

(22) Filed: Feb. 14, 2005

(65) Prior Publication Data

US 2005/0180156 A1 Aug. 18, 2005

(30) Foreign Application Priority Data

Feb. 17, 2004 (JP) ..... P2004-039770

(51) Int. Cl.
*F21V 7/00* (2006.01)

(52) U.S. Cl. ..... 362/517; 362/539; 362/507

(58) Field of Classification Search ..... 362/516–517, 362/538–539, 507
See application file for complete search history.

(56) References Cited

U.S. PATENT DOCUMENTS 4,914,747 A 4/1990 Nino
5,055,981 A * 10/1991 Nino ..... 362/539
5,938,323 A * 8/1999 McMahan ..... 362/539
6,454,448 B1 * 9/2002 Taniuchi et al. ..... 362/517
6,796,696 B1 * 9/2004 Taniuchi ..... 362/539
6,997,587 B1 * 2/2006 Albou ..... 362/516
2003/0202359 A1 10/2003 Albou
2005/0174794 A1 * 8/2005 Kagiyama ..... 362/538
2005/0248955 A1 * 11/2005 Nishizawa et al. ..... 362/514

FOREIGN PATENT DOCUMENTS

EP 0 750 157 A 12/1996
EP 1 357 332 A 10/2003
JP 6-41010 5/1994

* cited by examiner

*Primary Examiner*—Ali Alavi
(74) *Attorney, Agent, or Firm*—Brenda O. Holmes; Kilpatrick Stockton LLP

(57) ABSTRACT

Small projector type lamp devices for forming a cutoff line and for not forming the cutoff line having LED as a light source are formed by using small reflectors and small convex lenses made of resin. A shade having an approximately horizontal reflection surface extended to a rear side from a front end of a bent edge portion and a front end step portion formed in a front end of the reflection surface are formed in the small reflector of the lamp device, and a shade having the reflection surface is formed in the small reflector of the lamp device. A plurality of lamp devices are incorporated into a housing so as to structure a vehicular lamp device.

6 Claims, 14 Drawing Sheets

PROJECTOR TYPE VEHICULAR LAMP DEVICE

BACKGROUND OF THE INVENTION

1. Field of the Invention

The present invention relates to a projector type vehicular lamp device applied as a head lamp and using a light emitting diode (LED) in a light source.

2. Description of the Related Art

FIG. 1 shows a conventional projector type vehicular lamp device 100 (for example, refer to a microfilm of Japanese Utility Model Application No. 4-76322 (Japanese Utility Model Application Laid-Open Publication No. 6-41010). The vehicular lamp device 100 comprises a light source bulb 2 provided near a first focus of a concave mirror 1, and a convex lens 3 modulating a light flux outgoing from the light source bulb 2 and reflected on the concave mirror 1 to an approximately parallel light flux so as to emit to a front side of the vehicular lamp device 100 (a left side in FIG. 1).

In detail, the vehicular lamp device 100 is structured such that a shade 4 is provided between the light source bulb 2 and the convex lens 3, and a light distribution pattern having a preferable cut line can be obtained as a beam for when vehicles go by each other (hereinafter, refer to as a low beam) by the shade 4.

The light source bulb 2 is structured such that a filament thereof is positioned at the first focus of the concave mirror 1, and an electric connecting portion thereof is fitted to a tubular opening portion 1*a*. A frame 5 is attached to an open end of the concave mirror 1, the convex lens 3 is firmly attached to the frame 5, and the frame 5 bears the shade 4.

Further, the vehicular lamp device 100 is structured, as shown in FIG. 2, such that a ventilating through hole 1*b* is provided in an upper side just near the tubular opening portion 1*a* for attaching the light source bulb 2 in the concave mirror 1, and a pair of ventilating through holes 1*c* are provided in a lower side just near the same, respectively.

A temperature of the vehicular lamp device 100 becomes generally high in the periphery of the light source bulb 2 at a time of lighting, however, since a heat generated by the light source bulb 2 is radiated on the basis of a heat convection generated between the through holes 1*b* and 1*c*, the temperature around the light source bulb 2 is inhibited from being increased.

SUMMARY OF THE INVENTION

However, in the conventional vehicular lamp device 100, since the outgoing light of the light source bulb 2 has a high heat energy, it is impossible to achieve a sufficient heat radiation only by the through holes 1*b* and 1*c*, and it is necessary to form the convex lens 3 by a glass, whereby there is a problem that an increase of weight in the lamp device is caused.

Further, in the conventional vehicular lamp device 100, for example, the concave mirror 1 is formed by an aluminum evaporation plate, a resin or an iron plate, the convex lens 3 is formed by a glass, the shade 4 is formed by the aluminum evaporation plate or the iron plate, and the frame 5 is formed by the aluminum evaporation plate. As mentioned above, since the materials used in each of the parts are different in the vehicular lamp device 100, it is necessary to form each of the parts independently and assemble a plurality of parts, however, there is a problem that a dimension in an optical axial direction requiring a high accuracy is hard to become a design value due to a dispersion of assembly and a dispersion of part dimension, and a dispersion of light distributing performance is enlarged.

Further, the number of the parts in the vehicular lamp device 100 is large, whereby a parts management is complicated and an assembling man-hour is increased, so that there is a problem that a cost increase is caused by extension.

Since the vehicular lamp device 100 is provided with the through holes 1*b* and 1*c*, a reflecting performance near a center portion of the concave mirror 1 is lowered, and there is also a problem that an illumination intensity of a hot zone in the center portion of the light distributing pattern is lowered by extension.

Accordingly, an object of the present invention is to provide a projector type vehicular lamp device which can intend to reduce a weight of the lamp device and a number of parts, can stably obtain an excellent light distributing performance, and can obtain a sufficient illumination intensity of a hot zone of a light distributing pattern by achieving a reflecting performance of a concave mirror to the maximum.

In order to achieve the object mentioned above, in accordance with a first aspect of the present invention, there is provided a projector type vehicular lamp device comprising: a light source provided near a first focus of a concave mirror; a convex lens modulating a light flux outgoing from the light source and reflected by the concave mirror to an approximately parallel light flux so as to emit to a front side of the light device; and small reflectors for forming a cutoff line and small reflectors for not forming the cutoff line, wherein the small reflector for forming the cutoff line includes an upper reflector in which the small concave mirror is integrally formed, and a lower reflector which integrally forms a shade including an approximately horizontal reflection surface extended to a rear side from a front end of a bent edge portion formed along a meridional image surface, and a front end step portion formed by being notched in a band shape from an approximately center portion in a width direction of the reflection surface to one side front end in one side along the bent edge portion, and is connected to the upper reflector from a lower side, wherein the small reflector for not forming the cutoff line includes an upper reflector in which the small concave mirror is integrally formed, and a lower reflector which integrally forms a shade including an approximately horizontal reflection surface extended to a rear side from a front end of a bent edge portion formed along a meridional image surface, and is connected to the upper reflector from a lower side, wherein the small reflectors for forming the cutoff line and for not forming the cutoff line respectively include small projector type lamp devices for forming the cutoff line and for not forming the cutoff line by combining the upper reflector and the lower reflector in such a manner that the bent edge portion is positioned near a second focus of the small concave mirror, pinching the small convex lens between the upper reflector and the lower reflector, and fixing the light source to the upper reflector, and wherein the small projector type lamp devices for forming the cutoff line and for not forming the cutoff line are incorporated into a housing.

In accordance with the structure mentioned above, the light of the LED of the small projector type lamp device for forming a cutoff line and for not forming the cutoff line is emitted toward the small concave mirror in each of the small projector type lamp devices, is reflected by the small concave mirror so as to reach the small convex lens, and passes through the small convex lens, thereby being modulated to the parallel light flux so as to be emitted to the front side of the vehicular lamp device, so that it is possible to form a desired light distributing pattern as a whole.

BRIEF DESCRIPTION OF THE DRAWINGS

FIGS. 8A, 8B, 8C and 8D are views showing respective light distributing patterns of a plurality of small projector type lamp devices constituting the projector type vehicular lamp device in FIG. 3, in which FIG. 8A shows a horizontal diffusion type, FIG. 8B shows a focusing flat type, FIG. 8C is a horizontal diffusion type for a low beam having a cut line, and FIG. 8D is a focusing flat type for a low beam having a cut line;

FIGS. 9A, 9B and 9C are views showing a small projector type lamp device in accordance with an embodiment structuring the projector type vehicular lamp device of the present invention, in which FIG. 9A is a plan view of the same, FIG. 9B is a cross sectional view along a line IXB—IXB in FIG. 9A, and FIG. 9C is a front elevational view of the same as seen from a front side;

FIGS. 12A and 12B are views showing a small reflector applied to the small projector type lamp device for forming the cutoff line in FIG. 9, in which FIG. 12A is an exploded perspective view of the same, and FIG. 12B is a front elevational view of a lower reflector structuring the small reflector;

FIGS. 14A and 14B are views showing a lower reflector structuring a small reflector applied to a small projector type lamp device for forming a cutoff line in accordance with a comparative embodiment of the present invention, in which FIG. 14A is a perspective view of the same, and FIG. 14B is a front elevational view of the same;

FIGS. 15A and 15B are graphs showing a light distributing pattern of a small projector type lamp device for forming a cutoff line, in which FIG. 15A is a graph of the small projector type lamp device of the present invention, and FIG. 15B is a graph of the small projector type lamp device of the comparative embodiment; and FIGS. 16A and 16B are views showing a lower reflector structuring a small reflector applied to a small projector type lamp device for forming a cutoff line in accordance with the other embodiment of the present invention, in which FIG. 16A is a perspective view of the same, and FIG. 16B is an enlarged plan view of a main portion thereof.

DETAILED DESCRIPTION OF THE INVENTION

Figure 1:
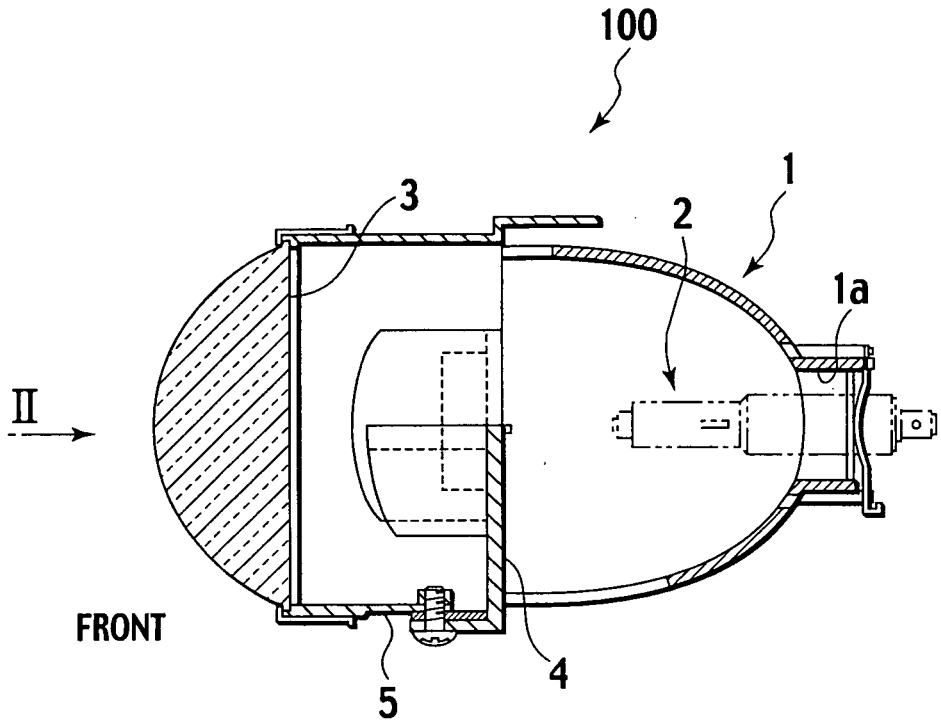
FIG. 1 is a central vertical cross sectional view of a conventional projector type vehicular lamp device.
Figure 2:
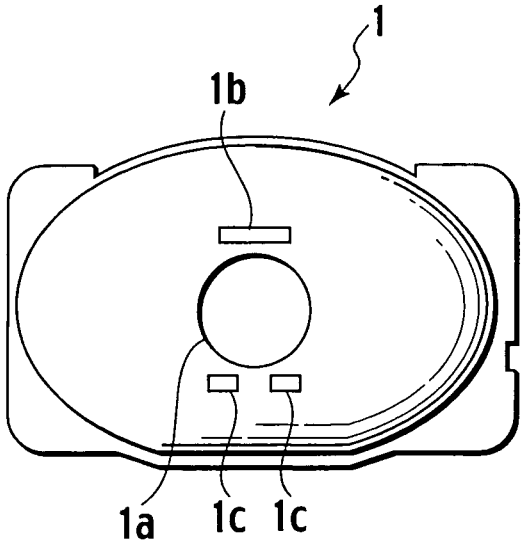
FIG. 2 is a front elevational view as seen from a direction of II in FIG. 1 and shows a concave mirror applied to the projector type vehicular lamp device in FIG. 1.

A description will be given below of the present invention on the basis of embodiments thereof. In this case, a description will be given of constituting elements having the same functions as those disclosed in FIGS. 1 and 2 by attaching the same reference numerals.

Figure 3:
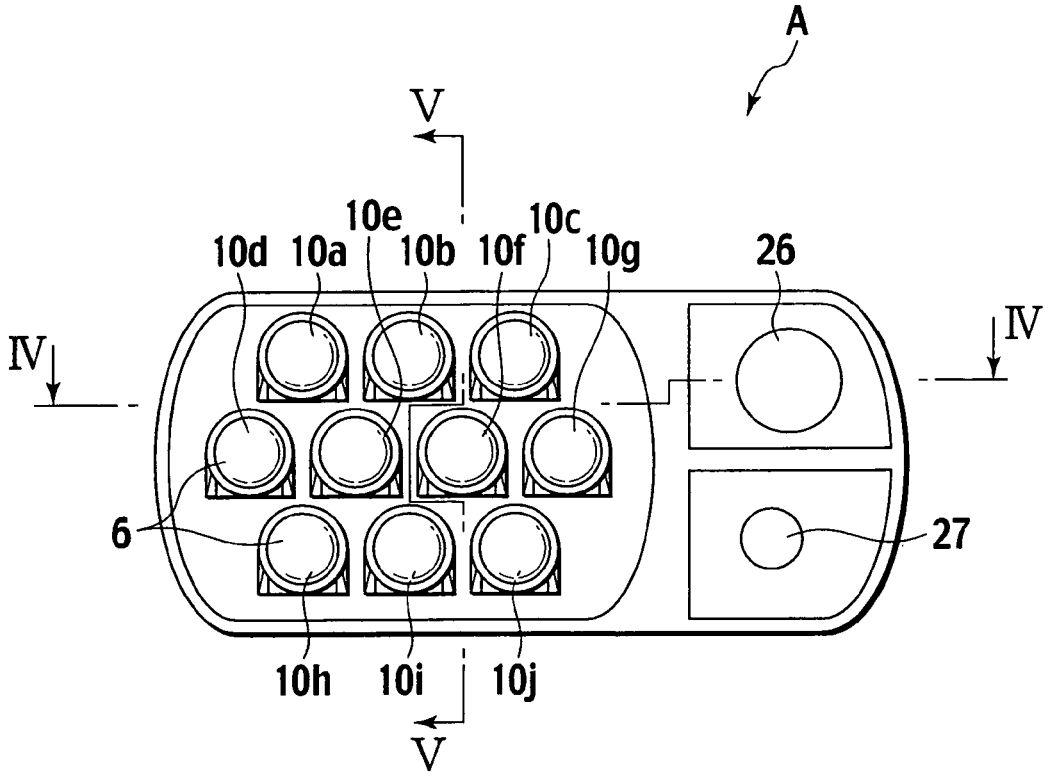
FIG. 3 is a front elevational view of an entire of a projector type vehicular lamp device corresponding to an embodiment of the present invention.
Figure 4:
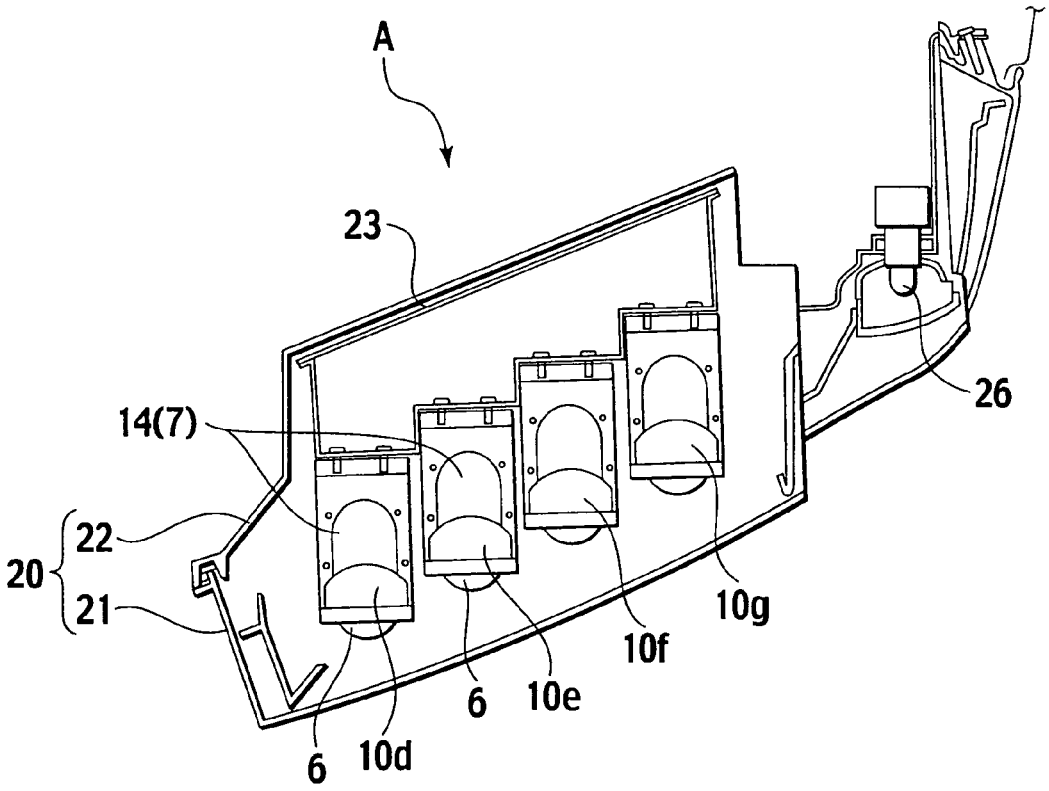
FIG. 4 is a cross sectional view along a line IV—IV of the projector type vehicular lamp device in FIG. 3.
Figure 5:
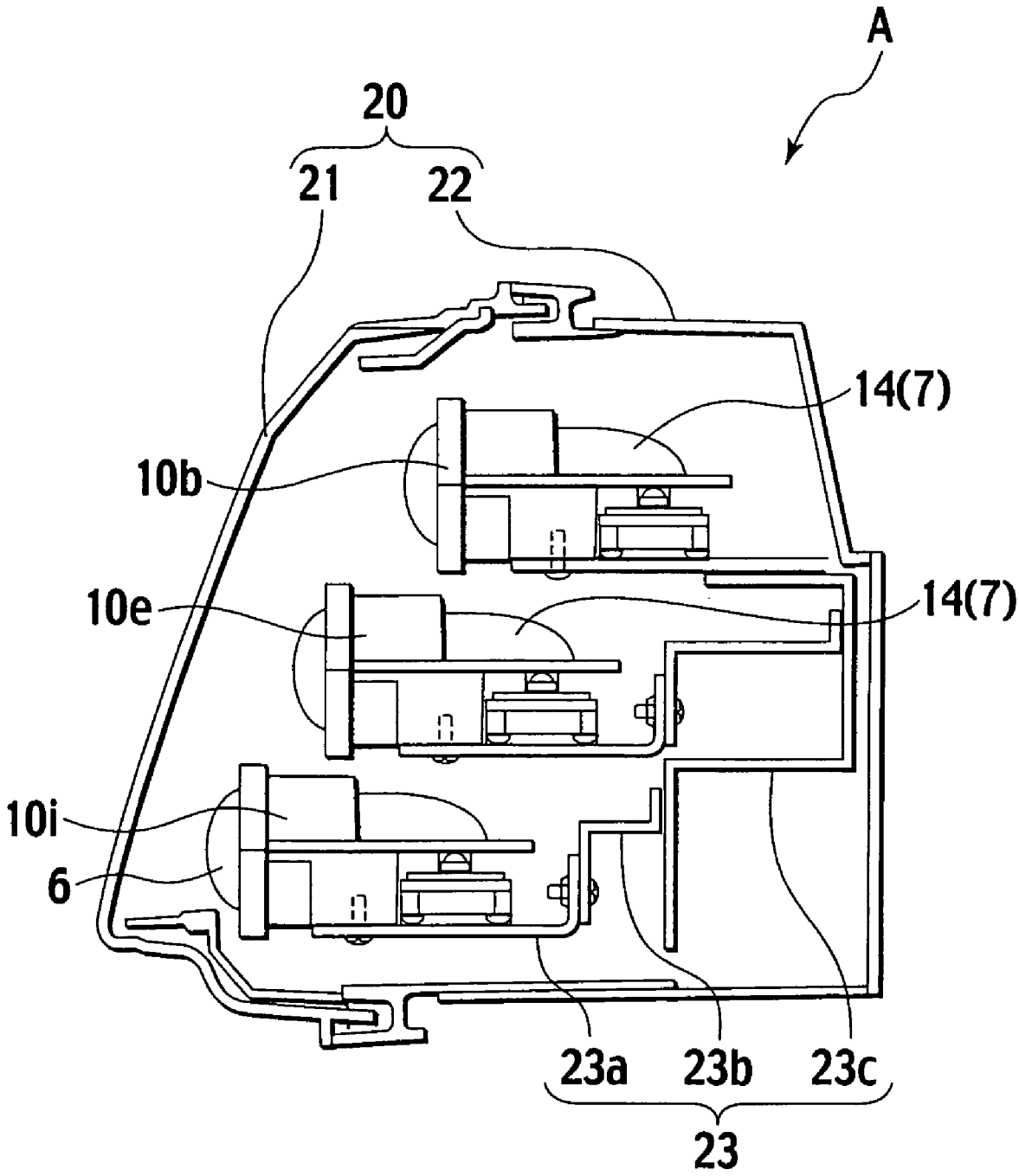
FIG. 5 is a cross sectional view along a line V—V of the projector type vehicular lamp device in FIG. 3.

FIGS. 3 to 5 show a projector type vehicular lamp device A of the present invention. The vehicular lamp device A including a plurality of small projector type lamp devices 10*a*, 10*b*, 10*c*, 10*d*, 10*e*, 10*f*, 10*g*, 10*h*, 10*i* and 10*j* each having an LED 11 (refer to FIG. 6) built-in as a light source into a housing 20 (refer to FIG. 4).

As shown in FIG. 4, the housing 20 includes a casing 22 in which a front portion is open (an opening of the casing 22), and a plain glass 21 covering the opening of the casing 22. Further, a plurality of the small projector type lamp devices 10*a* to 10*j* are incorporated into the housing 20 by being firmly fixed to the casing 22 via a mounting device 23. Further, the mounting device 23 is supported to the casing 22 so as to freely adjust an optical axis of an entire of a plurality of the small projector type lamp devices 10*a* through 10*j* vertically and laterally, by adjusting two adjust screws and pivot structures (not shown). Meanwhile, in FIGS. 3 to 5, reference numerals 26 and 27 respectively denote a clearance lamp and a front turn lamp.

Further, the small projector type lamp devices 10*a* to 10*j* performing as a head lamp are designed, for example, such that a light distributing pattern shown in FIGS. 8A to 8D can be obtained in accordance with a mounted position thereof.

Figure 8A:
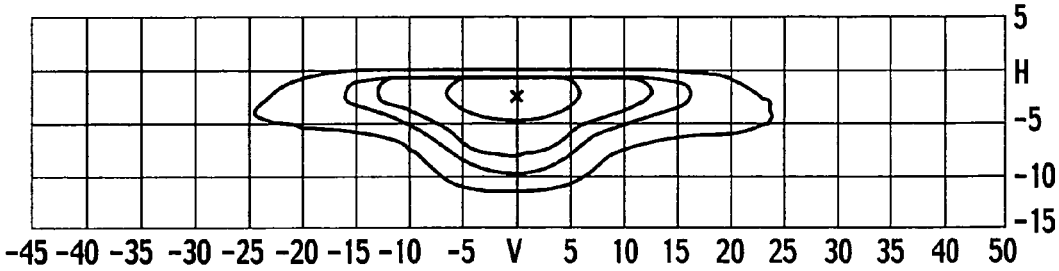
Figure 8B:
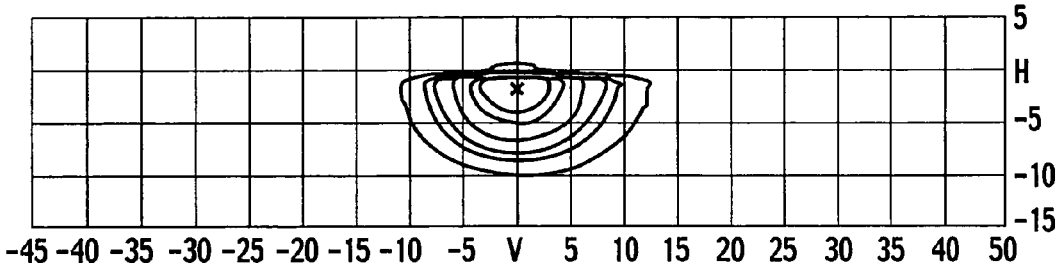
Figure 8C:
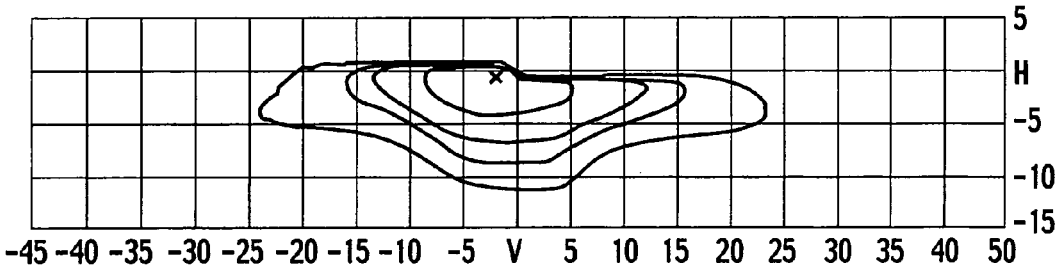
Figure 8D:
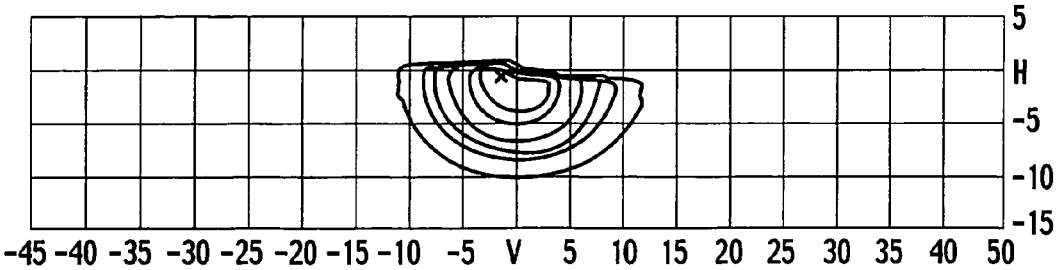

In FIGS. 8A to 8D, FIG. 8A shows a horizontal diffusion type (a first light distributing pattern), FIG. 8B shows a focusing flat type (a second light distributing pattern), FIG. 8C is a horizontal diffusion type for a low beam having a cutoff line (a third light distributing pattern), and FIG. 8D is a focusing flat type for a low beam having a cutoff line (a fourth light distributing pattern), respectively, and reference symbol X denotes an approximately center of the projector type vehicular lamp device A.

In the small projector type lamp devices 10*a* through 10*j*, the small projector type lamp devices 10*a*, 10*c*, 10*d* and 10*g* (first group) are designed such that the third light distributing pattern (refer to FIG. 8C) can be obtained, the small projector type lamp devices 10*b*, 10*e* and 10*f* (second group) are designed such that the fourth light distributing pattern (refer to FIG. 8D) can be obtained, and the small projector type lamp devices 10*h*, 10*i* and 10*j* (third group) are designed such that the first and second light distributing pattern (refer to FIGS. 8A and 8B) can be obtained, respectively. Further, the vehicular lamp device A can achieve a light distributing pattern LP suitable for the low beam shown in FIG. 11 in the case that all the small projector type lamp devices 10*a* to 10*j* are lighted.

In the vehicular lamp device A in accordance with the first embodiment, the small projector type lamp devices 10*a*, 10*b*, 10*c*, 10*d*, 10*e*, 10*f* and 10*g* achieving the third and fourth light distributing pattern comprise a small projector type lamp device (a first lamp device) 10A for forming the cutoff line shown in FIGS. 6, 9A to 9C, 12A and 12B. Further, the small projector type lamp devices 10*h*, 10*i* and 10*j* achieving the first and second light distributing pattern are structured by a small projector type lamp device (a second lamp device) 10B for not forming the cutoff line shown in FIGS. 6, 9A to 9C, 12A and 12B.

Figure 9A:
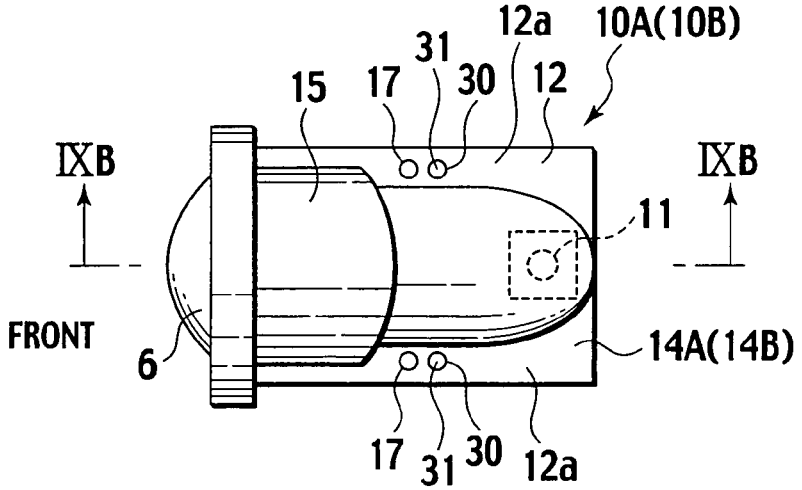
Figure 9B:
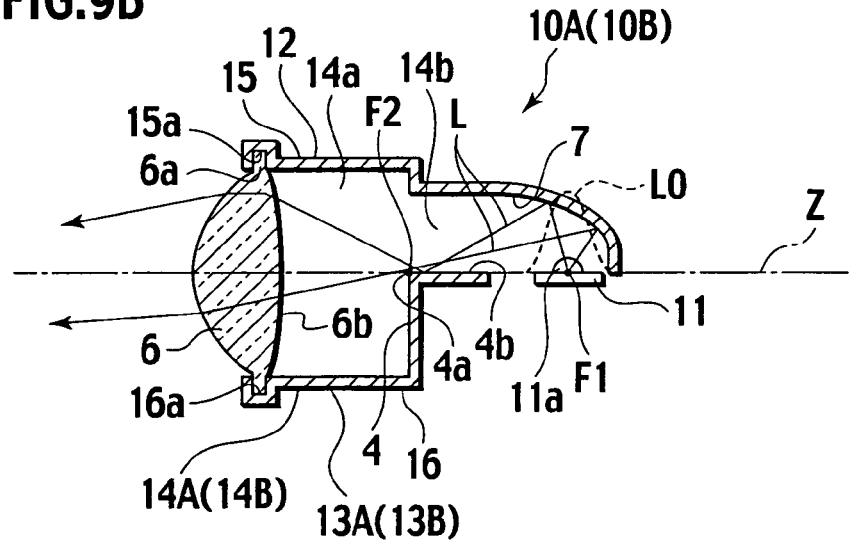
Figure 9C:
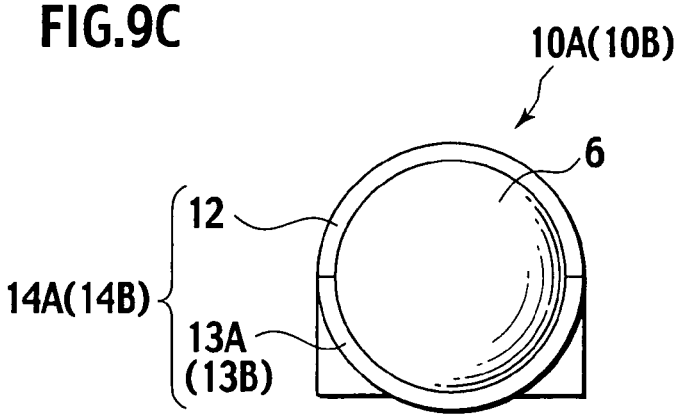

In the small projector type lamp devices 10A and 10B, as shown in FIG. 9B, the light source includes a plurality of LED 11 which are set one by one so as to make a light emitting portion 11*a* to oppose to a small concave mirror 7, near a first focus F1 of the small concave mirror 7 formed as a spheroidal curved surface or a free curved surface on the basis of a spheroid in each of a plurality of small reflectors 14A for forming the cutoff line and a plurality of small reflectors 14B for not forming the cutoff line.

The convex lens is structured by a small convex lens 6 covering respective front opening portions of a plurality of small reflectors 14A and 14B, and the small reflectors 14A and 14B and the small convex lenses 6 are formed by a resin, respectively. The small convex lens 6 at this time employs, for example, an aspheric double convex lens (refer to FIGS. 6 and 9B), the resin material employs, for example, a polycarbonate resin and an acrylic resin, and an acrylic resin which is excellent in an optical quality is employed particularly for the small convex lens 6.

Figure 12A:
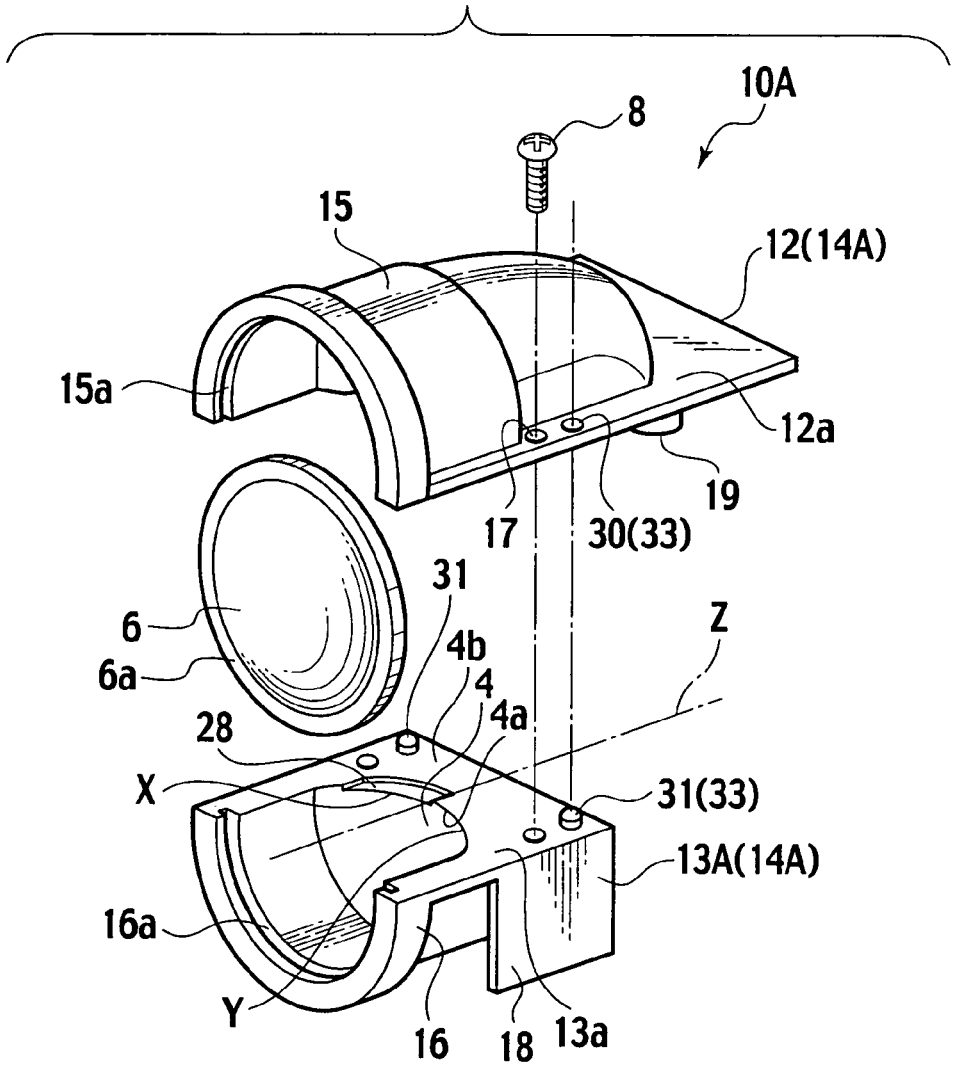
Figure 12B:
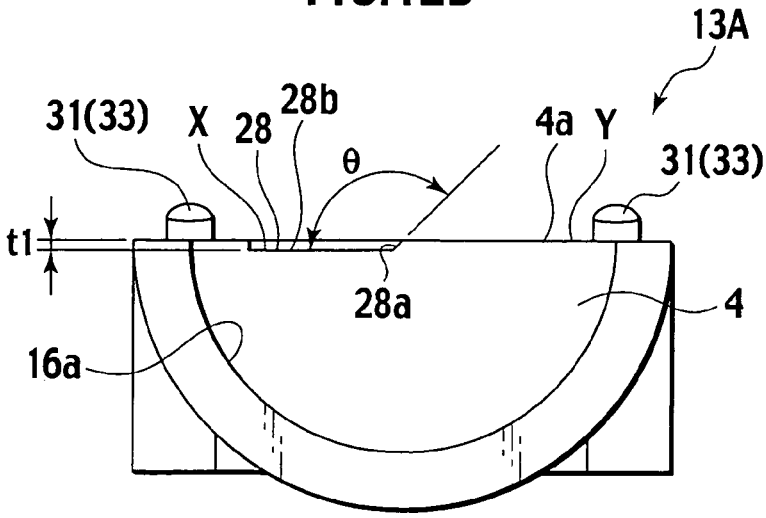

Mainly with reference to FIGS. 9B, 12A and 12B, the small reflector 14A for forming the cutoff line comprises an upper reflector 12 in which the small concave mirror 7 is integrally formed, and a lower reflector 13A which integrally forms a shade 4 including an approximately horizontal reflection surface 4*d* extended to a rear side from a front end of a bent edge portion 4*a* formed along a meridional image surface, and a front end step portion 28 formed by being notched in a band shape from an approximately center portion (corresponding to the optical axis Z of the small projector type lamp device 10A) in a width direction of the reflection surface 4*b* to one side front end X in one side (a right side in the present embodiment) (the other side being set to the other front end Y) along the bent edge portion 4*a*, and is connected to the upper reflector 12 from a lower side.

Figure 13:
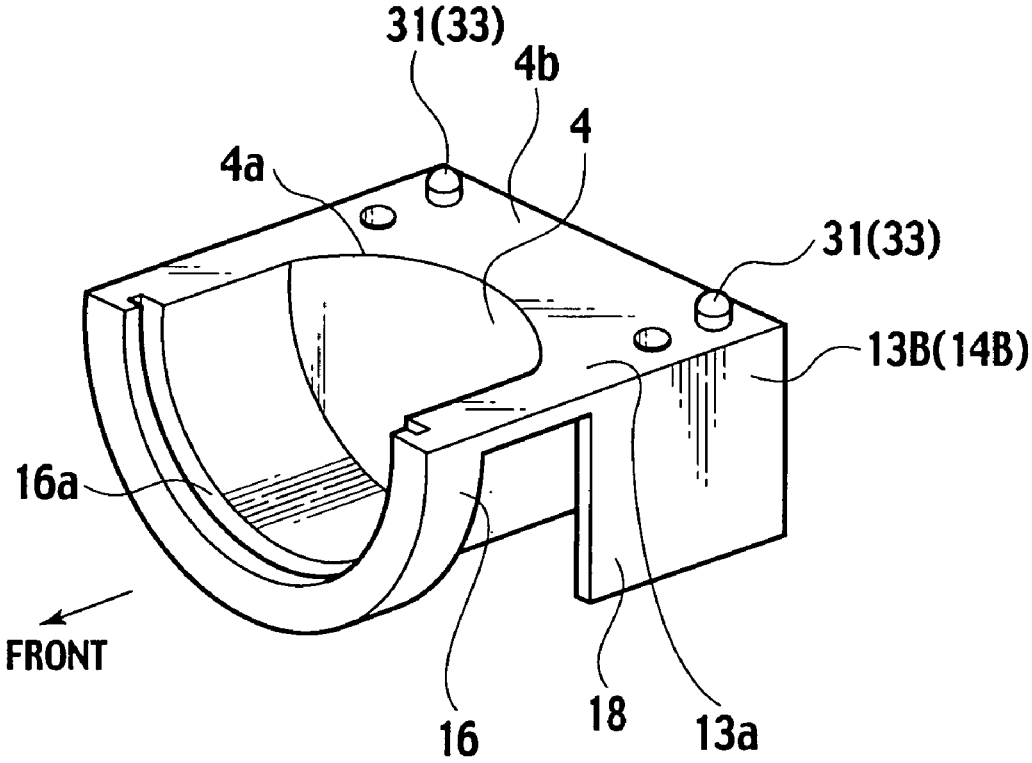
FIG. 13 is a perspective view of the lower reflector structuring the small reflector applied to the small projector type lamp device for not forming the cutoff line in FIG. 9.

Further, the small reflector 14B for not forming the cutoff line comprises an upper reflector 12 in which the small concave mirror 7 is integrally formed, and a lower reflector 13B (refer to FIG. 13) which integrally forms a shade 4 including an approximately horizontal reflection surface 4*d* extended to a rear side from a front end of a bent edge portion 4*a* formed along a meridional image surface, and is connected to the upper reflector 12 from a lower side. In other words, as is different from the small reflector 14A for forming the cutoff line, the front end step portion 28 is not formed in the small reflector 14B for not forming the cutoff line.

Further, the small reflectors 14A and 14B structure the small projector type lamp devices 10A and 10B for forming the cutoff line and for not forming the cutoff line, by combining the upper reflector 12 and the lower reflector 13A (13B) in such a manner that the bent edge portion 4*a* is positioned near the second focus F2 of the small concave mirror 7, pinching the small convex lens 6 between the upper reflector 12 and the lower reflector 13A (13B), and fixing the LED 11 to the upper reflector 12.

In particular, the upper reflector 12, which used for both of the small projector type lamp device 10A with cutoff line and the small projector type lamp device 10B without cutoff line, includes a larger-diameter upper casing portion 15, the diameter of which is larger than that of the small concave mirror 7. The upper casing portion 15 is formed continuously with a front end portion (a left side in FIG. 9) of the small concave mirror 7 and includes an upper lens fixing portion 15*a* formed in a groove shape along an inner periphery in a front end of the upper casing portion 15. Further, the reflecting member is evaporated on an inner surface of the upper reflector 12.

As mentioned above, the lower reflectors 13A and 13B are structured such as to have the common constituting elements except the matter that the front end step portion 28 is formed or not formed, and is structured such as to be provided with the shade 4 and the lower casing portion 16. The shade 4 is formed so as to be provided in a standing manner in a rear end portion of the lower casing portion 16 with an inverted-L-shaped cross section, as shown in FIG. 9B, the upper bent edge portion 4*a* is formed along the meridional image surface, and the reflection surface 4*b* corresponding to an upper line portion thereof is formed so as to have a reflector function by evaporating the reflecting member to an inner surface. Also, a lower lens fixing portion 16*a* is formed in a groove shape in a front end of the lower casing portion 16 along an inner periphery thereof.

Further, the front end step portion 28 is formed in a front end portion of one side front end X of the reflection surface 4*b* so as to have an inclined surface 28*a* forming an ascending incline with respect to the other side front end Y, and a flat surface 28*b* continuously provided with a lower end of the inclined surface 28*a*, for example, as shown in FIGS. 12A and 12B. The front end step portion 28 is formed such that an angle θ with respect to the flat surface 28*b* becomes, for example, about 135 degree, and the flat surface 28*b* is formed such that a depth t1 from the bent edge portion 4*a* of the other side front end Y becomes, for example, about 0.5 mm.

The small reflector 14A (14B) is structured by bringing flange portions 12*a* and 13*a* respectively forming both reflectors 12 and 13A (13B) in the outer peripheral portions thereof into contact therewith so as to combine by coupling means (described below). Accordingly, the small reflector 14A (14B) is structured such that an approximately half portion in a front side is formed in a closed cross section by both the casing portions 15 and 16, an approximately half portion in a rear side is formed in an approximately semi-circular cross section only by the small concave mirror 7 of the upper reflector 12, and the bent edge portion 4*a* of the shade 4 integrally provided in the lower reflector 13A (13B) is positioned near the second focus F2 (refer to FIG. 9B) of the small concave mirror 7.

Figure 6:
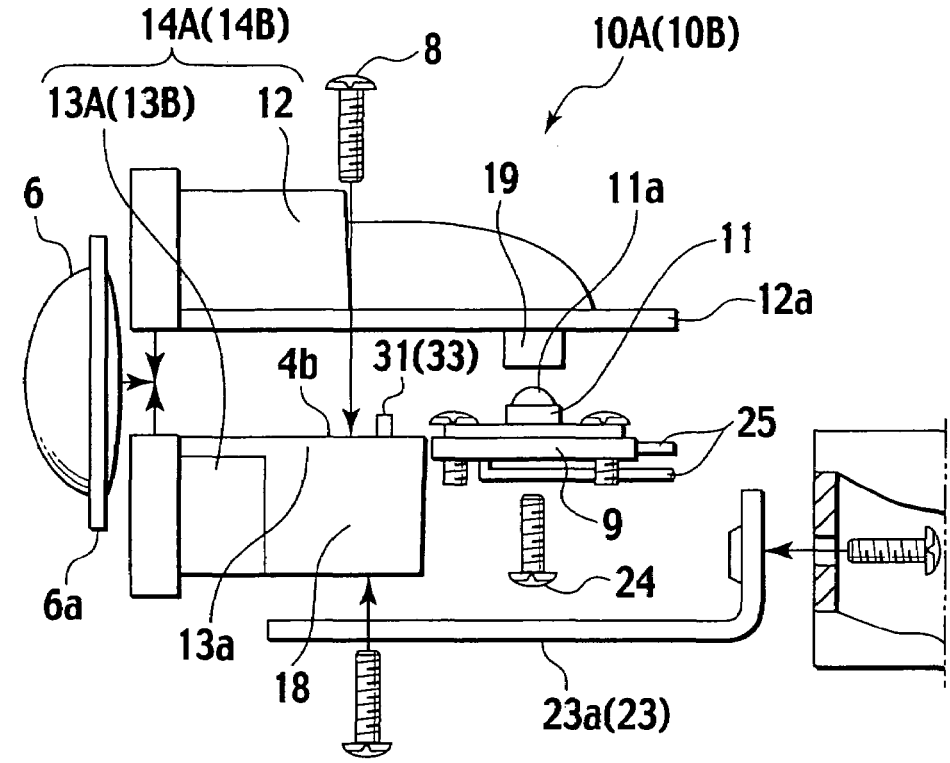
FIG. 6 is an exploded side elevational view of a small projector type lamp device applied to the projector type vehicular lamp device in FIG. 3.

The coupling means of this embodiment includes a screw 8, a thread hole 17 pierced in the flange portion 12*a* of the upper reflector 12, and a coupling boss portion 18 integrally provided in the lower reflector 13A (13B), as shown in FIGS. 4 and 12A, and can couple both the reflectors 12 and 13A (13B) by inserting the screw 8 to the thread hole 17 (refer to FIG. 9A) so as to be engaged with the coupling boss portion 18 (refer to FIG. 6).

The small convex lens 6 further includes a thin outer peripheral flange portion 6*a*, and is attached by fitting the outer peripheral flange portion 6*a* to both fixing portions 15*a* and 16*a* at a time of coupling both the reflectors 12 and 13A (13B).

Figure 10:
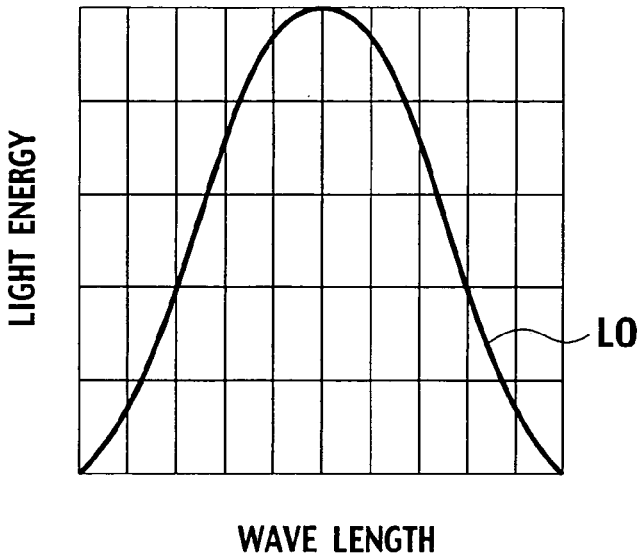
FIG. 10 is a graph showing an outgoing pattern of an outgoing light of an LED applied to the small projector type lamp device in FIG. 9.

Furthermore, the LED 11 is placed in a state in which the light emitting portion 11*a* thereof is arranged in an approximately orthogonal direction to the optical axis Z of the lamp device 10 passing through the center position of the small convex lens 6 and the first focus F1. FIG. 10 shows an outgoing pattern L0 of the light emitted from the light emitting portion 11*a* of the LED 11, and a broken line in FIG. 9B shows an incoming state of the light of the outgoing pattern L0 to the small concave mirror 7.

The small projector type lamp devices 10A and 10B for forming the cutoff line and for not forming the cutoff line structured as mentioned above are structured, as shown in FIG. 9B, such that a front side lamp chamber 14*a* is formed by the small convex lens 6, the upper casing portion 15 and the lower casing portion 16, and a rear side lamp chamber 14*b* is formed by the small concave mirror 7, the reflection surface 4*b* of the shade 4 partially covering the front side lower portion of the small concave mirror 7, and the LED 11 fixed to the upper reflector 12 so as to make the light emitting portion 11*a* to oppose to the small concave mirror 7.

The vehicular lamp device A is structured such that a plurality of small projector type lamp devices 10*a* to 10*j* are constituted by the small projector type lamp devices 10A and 10B for forming the cutoff line and for not forming the cutoff line, and is attached to the casing 22 so as to make the small convex lens 6 to oppose to the plain glass 21 by appropriately using the mounting device 23 constituted by a first mounting device 23*a*, a second mounting device 23*b* and a third mounting device 23*c* and set the upper and lower reflectors 12 and 13A (13B) respectively to an upper side and a lower side.

In the vehicular lamp device A structured in the manner mentioned above, in both for forming the cutoff line and for not forming the cutoff line, the light L of the LED 11 is, as shown in FIG. 9B, emitted toward the reflection surface of the small concave mirror 7 from the light emitting portion 11*a* thereof, is reflected by the reflection surface of the small concave mirror 7, and is thereafter focused to the shade 4 formed at the position of the second focus F2 of the small concave mirror 7, and a part of the focused light is shielded by the shade 4, and the other part is reflected by the reflection surface 4*b*, thereby forming a light distributing pattern provided with the predefined cutoff line so as to be projected to a front side of the vehicular lamp device A.

Figure 11:
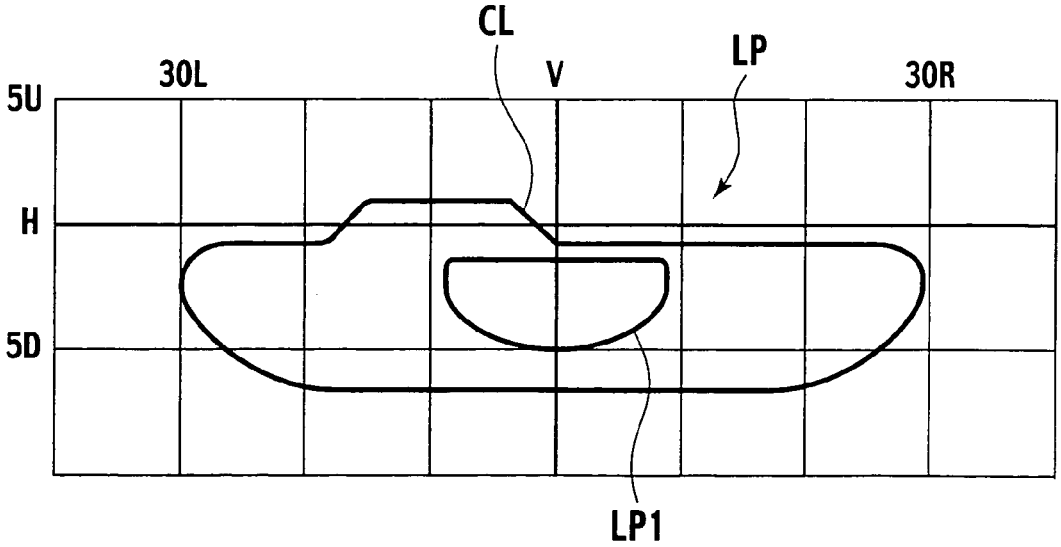
FIG. 11 is a graph showing a light distributing pattern of a projector type vehicular lamp device constituted by the small projector type lamp devices in FIG. 9.

FIG. 11 shows a light distributing pattern LP at this time, and this light distributing pattern LP is preferable for the low beam by forming a cutoff line CL.

In addition, since the shade 4 is formed so as to have the approximately horizontal reflection surface 4*b* both for forming the cutoff line and for not forming the cutoff line, it is possible to efficiently reflect the reflected light of the small concave mirror 7 to the front side by the reflection surface 4*b*, whereby it is possible to increase an amount of light flux emitted via the small concave lens 6, and to improve the illumination intensity.

Further, since it is not necessary to pierce the hole for adjusting the temperature in the small concave mirror 7, it is possible to achieve the reflecting performance of the small concave mirror 7 to the maximum, and it is possible to improve an illumination intensity of a hot zone LP1 (refer to FIG. 11) together with the reflection of the reflection surface 4*b* mentioned above.

Furthermore, since the LED 11 applied as the light source is small in size in itself, it is possible to save a space required for mounting so as to make the small reflector 14A (14B) compact, and since the heat energy of the emitted light L is smaller in comparison with the conventional light source with filament (refer to the light source bulb 2 in FIG. 1), it is also possible to avoid an excessive temperature increase of the lamp chamber, make the small concave lens 6 and the small reflector 14A (14B) of the resin, and achieve the compact structure of the lamp device A and the reduction of weight on the whole.

Further, since the small convex lens 6 and the small reflectors 14A and 14B for forming the cutoff line and for not forming the cutoff line are made of the resin, it is possible to form them with an improved dimensional accuracy in comparison with the structure using the iron plate or the aluminum evaporated plate. Further, since the small concave mirror 7 is integrally formed in one upper reflector 12 structuring the small reflectors 14A and 14B for forming the cutoff line and for not forming the cutoff line, the shade 4 is integrally formed in the other lower reflector 13A (13B), and both the reflectors 12 and 13A (13B) are coupled, it is possible to accurately set the relative positions of the small convex lens 6, the small concave mirror 7, the LED 11 and the shade 4 a positional relation of which is optically important, and form the small projector type lamp devices 10A and 10B which are optically excellent so as to have a stable quality.

Figure 15A:
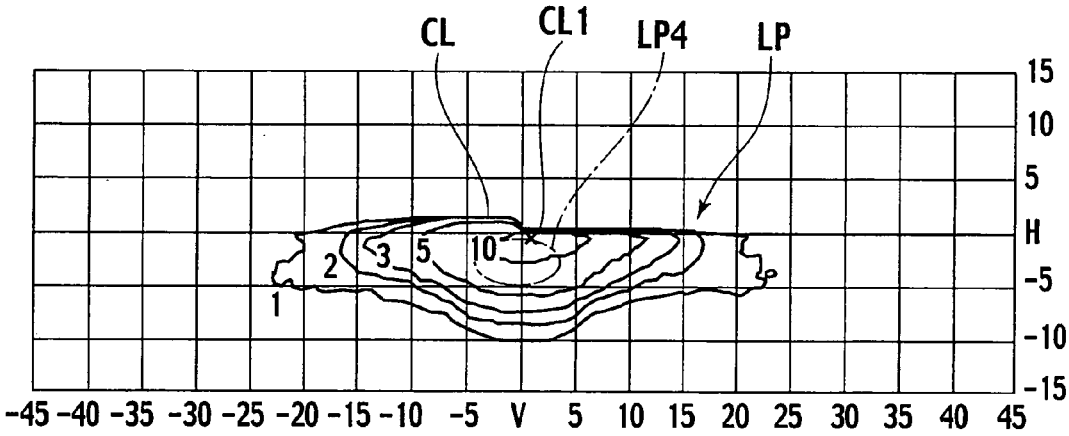

Further, as shown in FIG. 15A, it is possible to achieve a light distributing pattern LP having a cutoff line CL of a low beam by the small projector type lamp device 10A for forming the cutoff line, an illumination intensity of the lower position LP2 of the bent portion CL1 of the cutoff line CL appearing in the light distributing pattern LP at this time becomes uniform, and it is possible to cancel an illumination intensity spot at the position by the front end step portion 28 formed only in the front end portion of the reflection surface 4*b* of the shade 4.

Figure 14A:
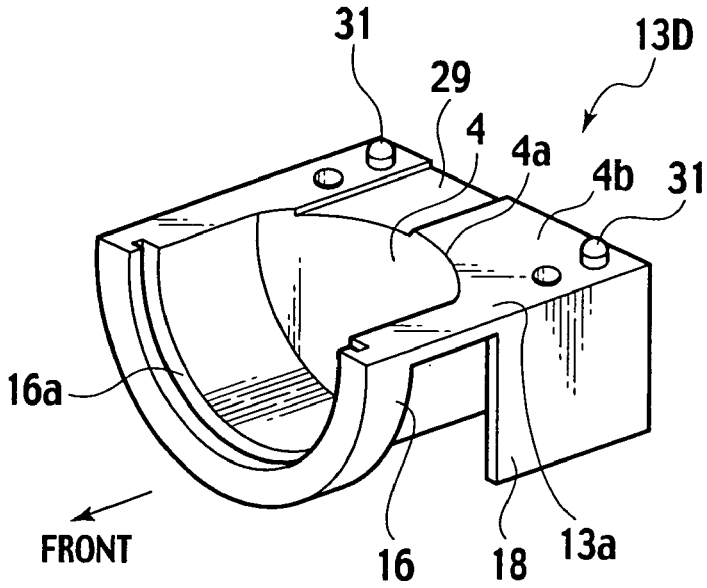
Figure 14B:
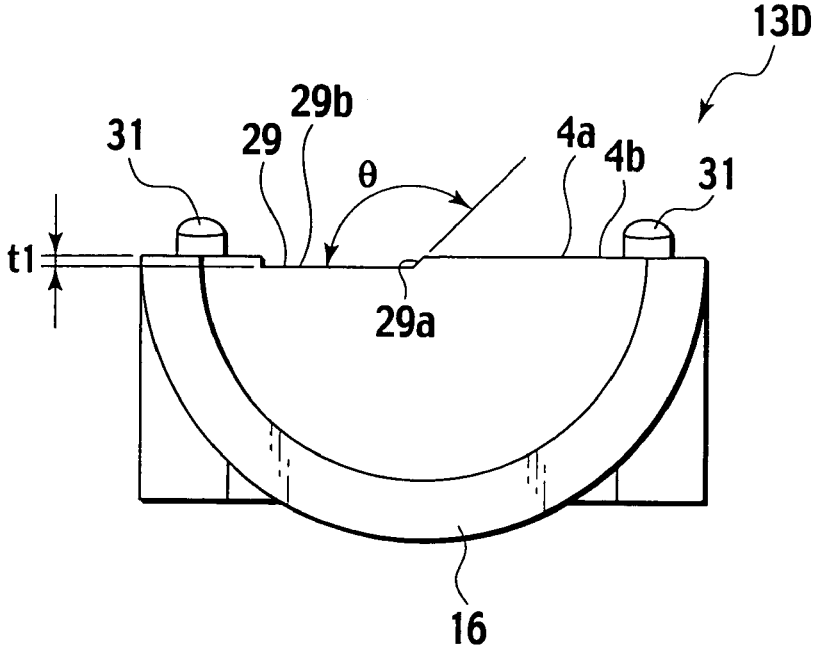
Figure 15B:
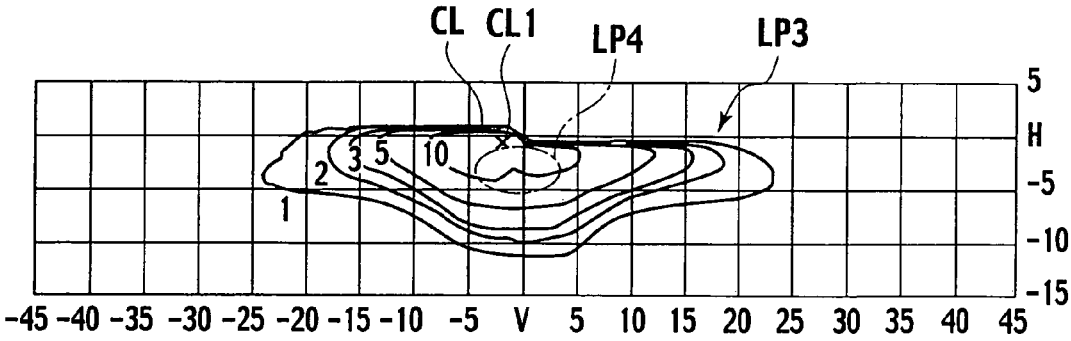

In this connection, FIGS. 14A and 14B show a lower reflector 13D in accordance with a comparative embodiment, in which a step portion formed in the shade 4 has an entire step portion 29 which is formed from a front end of the reflection surface 4*b* of the shade 4 to an entire surface in a depth direction. The entire step portion 29 includes an inclined surface 29*a* and a flat surface 29*b* having the same angle θ and depth t1 as those of the front end step portion 28 mentioned above. Further, the small projector type lamp device 10A for forming the cutoff line structured by using the lower reflector 13D achieves a light distributing pattern LP3 in which an illumination intensity of a lower position LP4 of the bent portion CL1 of the cutoff line CL is uneven as shown in FIG. 15B, a light line is generated from the vehicle to a front side of a road surface due to the illumination intensity spot at the position, and there is a risk that an uncomfortable feeling is applied to the driver.

Figure 16A:
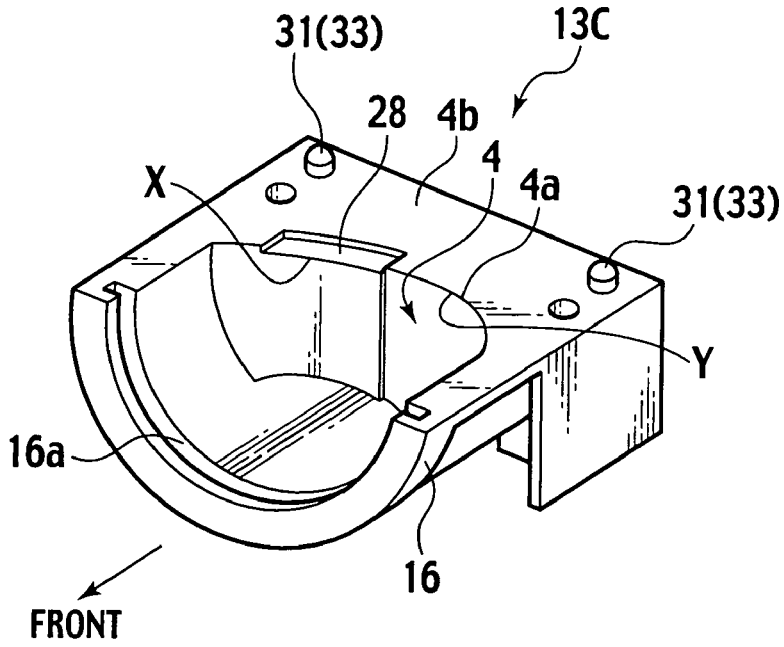
Figure 16B:
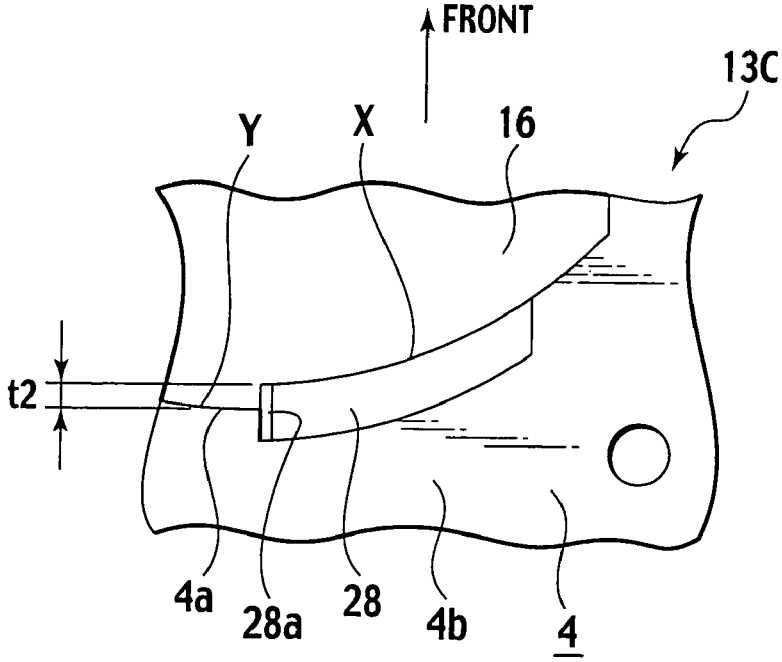

FIGS. 16A and 16B show a lower reflector 13C in accordance with the other embodiment. The lower reflector 13C is coupled to the upper reflector 12 so as to structure the small reflector 14A for forming the cutoff line, structures the small projector type lamp device 10A for forming the cutoff line by extension, and is different only in a shape of the front end of the reflection surface 4*b* of the shade 4, and the other structure is made in the same manner as the lower reflector 13A.

In other words, the lower reflector 13C is formed such that the front end X of the front end step portion 28 protrudes toward a front side from the other side front end Y constituted by the bent edge portion 4*a*.

In particular, one side front end X is formed by being protruded toward the front side at a protruding amount t2 from the other side front end Y, as shown in FIG. 16B. The protruding amount t2 at this time is, for example, about 1 to 2 mm.

Further, the small projector type lamp device 10A for forming the cutoff line with the lower reflector 13C can achieve the light distributing pattern LP shown in FIG. 15A, and can cancel a chromatic aberration near the cutoff line CL appearing in the light distributing pattern LP by cutting a factor light of the chromatic aberration, on the basis of the front end step portion 28 in one side front end X of the shade 4 formed so as to be protruded to the front side, whereby a non-uniformity of a light distributing color can be canceled, and it is possible to improve a visibility with respect to a vehicle on an opposite lane, a pedestrian and the like. The cause light (factor light) at this time is constituted by an incoming light to an outer peripheral edge portion of the small convex lens 6.

Further, in preferable, as in above embodiments, a light source fixing portion 19 is integrally formed in the upper reflector 12, the LED 11 is fixed to the upper reflector 12 via the light source fixing portion 19 so as to serve as a sub-assembled member, and the upper and lower reflectors 12 and 13A (13B, 13C) are provided with a positioning means (positioner) 33 for determining a mutual position at a time of coupling both the reflectors.

Figure 7:
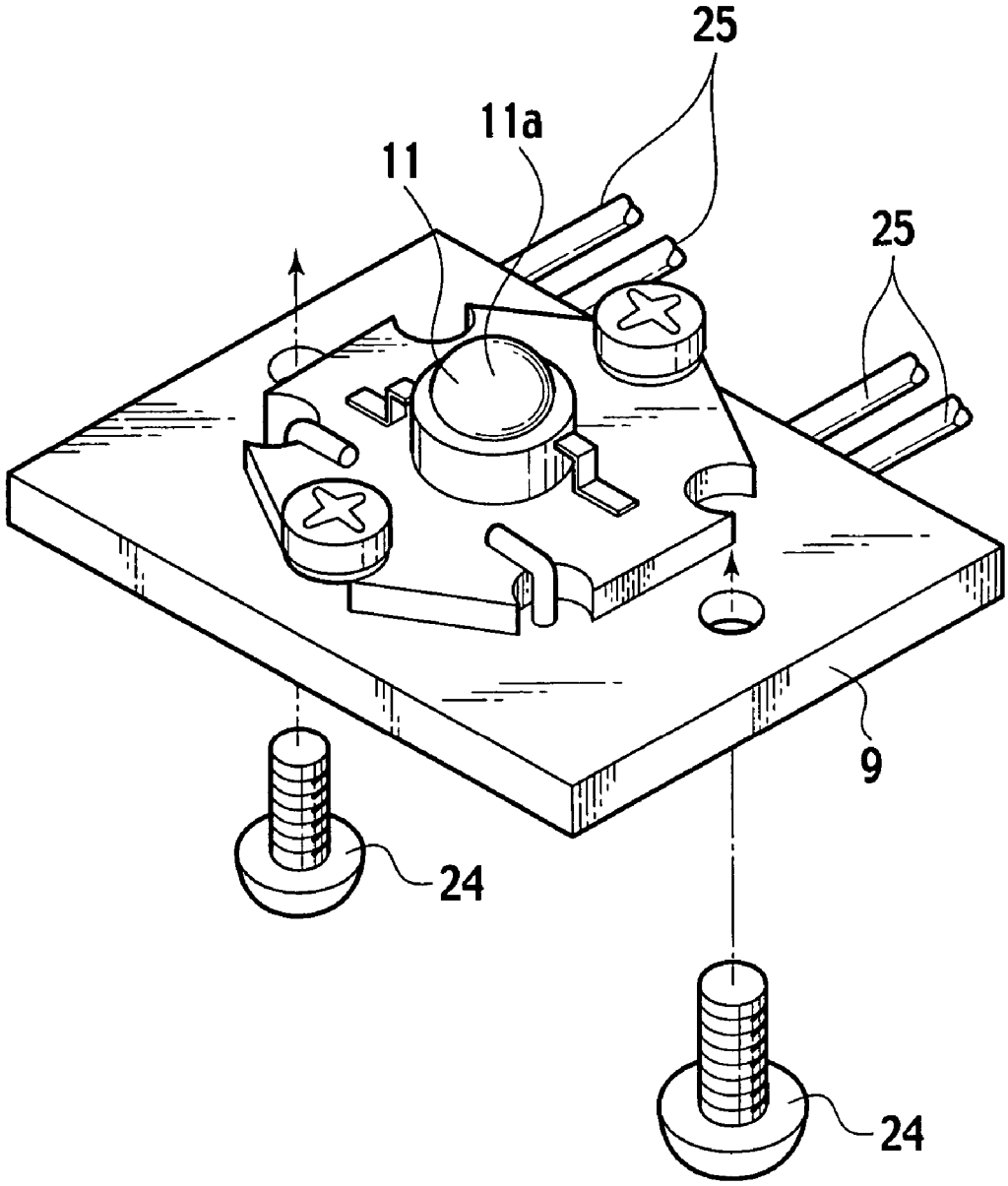
FIG. 7 is a perspective view of a sub-assembled member of an LED applied to the light source of the small projector type vehicular lamp device in FIG. 6.

In particular, the LED 11 is firmly fixed to the mounting plate 9 so as to be sub-assembled as shown in FIGS. 6 and 7, and the light emitting portion 11*a* is attached so as to oppose to the small concave mirror 7 by coupling the mounting plate 9 to the light source fixing portion 19 provided in an approximately half portion in a rear side of the upper reflector 12 by a screw 24. In FIGS. 6 and 7, reference numerals 25 denote four lead wires, in which two are lead wires for the LED 11, and the other two are lead wired for a cooling device (not shown).

The light source fixing portion 19 is formed in a back surface side of the flange portion 12*a* in both sides of the small concave mirror 7, as a boss portion having a thread hole in a center portion thereof, as shown in FIGS. 6 and 12A. The light emitting portion 11*a* of the LED 11 is accurately positioned near the first focus 1 of the small concave mirror 7 by fixing the sub-assembly of the LED 11 to the upper reflector 12 via the light source fixing portion 19.

The positioning means 33 is constituted by an engagement hole 30 pierced in the flange portions 12*a* in both sides of the small concave mirror 7 of the upper reflector 12, and an engagement projection 31 provided in a protruding manner in both sides of a rear portion of the reflection surface 4*b* of the shade 4 and provided so as to be inserted to the engagement hole 30, as shown in FIGS. 6, 12A, 13 and 16A.

The upper reflector 12 and any one of the lower reflectors 13A, 13B and 13C can accurately determine a coupling position thereof by inserting the engagement hole 30 to the engagement projection 31 at a time of coupling, it is possible to accurately determine the relative positions of the small convex lens 6, the small concave mirror 7, the LED 11 and the shade 4 which are optically important in the positional relation, together with the matter that the LED 11 is accurately fixed via the light source fixing portion 19, and it is possible to form the small projector type lamp devices 10A and 10B which are excellent optically as the structure having a stable quality by extension.

Further, since the number of the parts is smaller in the small projector type lamp devices 10A and 10B for forming the cutoff line and for not forming the cutoff line than the conventional one, a parts management is easily achieved, it is easy to assemble them, and it is also possible to achieve a cost reduction.

As in detail described above, in accordance with the present invention, since the LED applied as the light source is compact in itself, it is possible to save a space required for mounting so as to make the small reflector compact, and since the heat energy of the emitted light is smaller in comparison with the light source with filament, it is possible to avoid an excessive temperature increase of the lamp chamber, it is also possible to make the small concave lens and the small reflectors for forming the cutoff line and for not forming the cutoff line of the resin, and it is therefore possible to achieve the compact structure of the entire lamp device and the reduction of weight on the whole.

Further, since it is not necessary to pierce the hole for ventilation in the small concave mirror, and the small reflectors for forming the cutoff line and for not forming the cutoff line are both structured such that the shade is formed so as to have the approximately horizontal reflection surface, it is possible to achieve the reflecting performance of the small concave mirror to the maximum so as to increase the amount of the light flux emitted via the small convex lens. Accordingly, it is possible to obtain a sufficient illumination intensity of the hot zone of the light distributing pattern, and it is possible to improve a visibility on a cruising lane by extension.

Further, since the small convex lens and the small reflectors for forming the cutoff line and for not forming the cutoff line are made of the resin, it is possible to form them with an improved dimensional accuracy in comparison with the structure using the iron plate or the aluminum evaporated plate. Further, since the small concave mirror is integrally formed in one upper reflector structuring the small reflectors for forming the cutoff line and for not forming the cutoff line, the shade is integrally formed in the other lower reflector, and, by both the reflectors being coupled, it is possible to accurately set the relative positions of the small convex lens, the small concave mirror, the LED and the shade a positional relation of which is optically important, whereby it is possible to form the small projector type lamp device which is optically excellent so as to have a stable quality.

Further, since it is possible to cancel the illumination intensity spot at the lower position of the bent portion of the cutoff line appearing in the light distributing pattern having the cutoff line of the low beam obtained by the small projector type lamp device for forming the cutoff line by the front end step portion formed in the shade, the forward irradiation with no illumination intensity spot can be achieved.

Further, since the number of the parts is small, the parts management can be easily achieved, the parts can be easily assembled, and, by extension, the cost reduction can be achieved.

Further, in accordance with the present invention, since it is possible to cancel the chromatic aberration near the cutoff line appearing in the light distributing pattern by cutting the factor light of the chromatic aberration, on the basis of the front end step portion of the shade formed so as to be protruded to the front side, the non-uniformity of the light distributing color can be canceled, and it is possible to improve the visibility with respect to the vehicle on the opposite lane, the pedestrian and the like.

Further, in accordance with the present invention, since it is possible to accurately set the light emitting portion of the LED near the first focus of the small concave mirror of the small concave mirror by fixing the sub-assembled member of the LED to the upper reflector via the light source fixing portion, and the upper and lower reflectors can be accurately coupled in the coupled position by the positioning means, it is possible to form the small projector type lamp device which is optically excellent so as to have a stable quality.

The entire content of a Japanese Application No. P2004-039770 with a filing date of Feb. 17, 2004 is herein incorporated by reference.

Although the invention has been described above by reference to certain embodiments of the present invention, the invention is not limited to the embodiments described above and will occur to those skilled in the art, in light of the teachings. The scope of the invention is defined with reference to the following claims.

What is claimed is:

1. A projector type vehicular lamp device comprising:

a light source provided near a first focus of a concave mirror;

a convex lens modulating a light flux outgoing from the light source and reflected by the concave mirror to an approximately parallel light flux so as to emit to a front side of the light device; and small reflectors for forming a cutoff line and small reflectors for not forming the cutoff line, wherein the small reflector for forming the cutoff line includes an upper reflector in which the small concave mirror is integrally formed, and a lower reflector which integrally forms a shade including an approximately horizontal reflection surface extended to a rear side from a front end of a bent edge portion formed along a meridional image surface, and a front end step portion formed by being notched in a band shape from an approximately center portion in a width direction of the reflection surface to one side front end in one side along the bent edge portion, and is connected to the upper reflector from a lower side, wherein the small reflector for not forming the cutoff line includes an upper reflector in which the small concave mirror is integrally formed, and a lower reflector which integrally forms a shade including an approximately horizontal reflection surface extended to a rear side from a front end of a bent edge portion formed along a meridional image surface, and is connected to the upper reflector from a lower side, wherein the small reflectors for forming the cutoff line and for not forming the cutoff line respectively structure small projector type lamp devices for forming the cutoff line and for not forming the cutoff line by combining the upper reflector and the lower reflector in such a manner that the bent edge portion is positioned near a second focus of the small concave mirror, pinching the small convex lens between the upper reflector and the lower reflector, and fixing the light source to the upper reflector, and wherein the small projector type lamp devices for forming the cutoff line and for not forming the cutoff line are incorporated into a housing.

2. A projector type vehicular lamp device of claim 1, wherein a front end of a reflection surface in the shade of the small reflector for forming the cutoff line includes one side front end of the front end step portion and the other side front end portion constituted by the bent edge portion, and the one side front end protrudes from the other side front end.

3. A projector type vehicular lamp device of claim 1, wherein a light source fixing portion is integrally formed in the upper reflector in the small reflectors for forming the cutoff line and for not forming the cutoff line, the upper and lower reflectors are provided with a positioner for determining a mutual position at a time of coupling both the reflectors, and the light source is fixed as a sub-assembled member to the upper reflector via the light source fixing portion.

4. A projector type vehicular lamp device of claim 1, wherein the light source is comprised by LEDs which is positioned to make a light emitting portion to oppose to the small concave mirror, near the first focus of the small concave mirror formed as a spheroidal curved surface or a free curved surface on the basis of a spheroid in each of small reflectors.

5. A projector type vehicular lamp device of claim 1, wherein the small reflector and the small convex lens are formed by a resin.

6. A projector type vehicular lamp device of claim 1, wherein the convex lens is structured by a plurality of small convex lenses which cover the respective front opening portions of the plurality of small reflectors.

* * * * *